US009648935B2

(12) United States Patent
Lee

(10) Patent No.: US 9,648,935 B2
(45) **Date of Patent: *May 16, 2017**

(54) HAIR CURLING DEVICES AND RELATED SYSTEMS AND METHODS

(71) Applicant: Kiss Nail Products, Inc., Port Washington, NY (US)

(72) Inventor: Kyoung Hak Lee, Plainview, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/151,559

(22) Filed: Jan. 9, 2014

(65) Prior Publication Data

US 2015/0128985 A1 May 14, 2015

Related U.S. Application Data

(60) Provisional application No. 61/901,969, filed on Nov. 20, 2013.

(51) Int. Cl.

| | |
|---|---|
| ***A45D 1/04*** | (2006.01) |
| ***A45D 1/10*** | (2006.01) |
| ***A45D 6/02*** | (2006.01) |
| ***A45D 1/02*** | (2006.01) |

(Continued)

(52) U.S. Cl.

CPC ..... *A45D 6/02* (2013.01); *A45D 1/02* (2013.01); *A45D 1/04* (2013.01); *A45D 1/10* (2013.01); *A45D 1/18* (2013.01); *A45D 7/02* (2013.01)

(58) Field of Classification Search

CPC ... A45D 1/00; A45D 1/04; A45D 1/10; A45D 1/16; A45D 1/18; A45D 1/28; A45D 6/02

USPC ..... 132/266–269, 264, 253–254, 240–243, 132/235–238, 226–230, 119.1; 446/296; 219/222, 225

See application file for complete search history.

(56) References Cited

U.S. PATENT DOCUMENTS

| | | | |
|---|---|---|---|
| 1,429,167 | A | 9/1922 | Scharer |
| 1,623,758 | A | 4/1927 | Santurello |
| 1,661,747 | A | 3/1928 | Capdevila |

(Continued)

FOREIGN PATENT DOCUMENTS

| | | |
|---|---|---|
| CN | 201958032 | 9/2011 |
| CN | 102711549 | 10/2012 |

(Continued)

OTHER PUBLICATIONS

Sedu Revolution Clipless Curling Iron, Folica, http://www.folica.com/tools/curling-irons/sedu-revolution-clipless-curling.iron, (Screenshot taken on Nov. 25, 2013).

(Continued)

*Primary Examiner* — Todd E Manahan
*Assistant Examiner* — Jennifer Gill
(74) *Attorney, Agent, or Firm* — Jones Day

(57) ABSTRACT

In some aspects, a hair styling apparatus (e.g., hair curling device) can include a heated barrel connected to a handle device and generally stationary relative to the handle device during use, the heated barrel defining a hair styling surface and a rotating member disposed at an end of the hair styling surface, the rotating member being configured to rotate relative to the hair styling surface and to gather a user's hair and wind the hair around the hair styling surface.

28 Claims, 6 Drawing Sheets

(51) Int. Cl.
*A45D 7/02* (2006.01)
*A45D 1/18* (2006.01)

(56) References Cited

U.S. PATENT DOCUMENTS

| | | | | | |
|---|---|---|---|---|---|
| 1,662,411 | A | | 3/1928 | Bonat et al. | |
| 1,763,655 | A | | 6/1930 | Ingrassia | |
| 1,815,266 | A | | 7/1931 | Bonat et al. | |
| 2,527,218 | A | * | 10/1950 | Heaton | A45D 2/02 132/266 |
| 3,057,363 | A | * | 10/1962 | Talbot | 132/211 |
| 3,105,503 | A | | 10/1963 | Safianoff | |
| 3,890,984 | A | | 6/1975 | Lesetar | |
| 4,024,375 | A | * | 5/1977 | Olesen et al. | 219/225 |
| 4,177,824 | A | * | 12/1979 | Gnaga | 132/238 |
| 4,314,137 | A | | 2/1982 | Dorn | |
| 4,329,567 | A | * | 5/1982 | Kunz et al. | 219/222 |
| 4,419,565 | A | | 12/1983 | McGaw | |
| 4,443,688 | A | | 4/1984 | Andis | |
| 4,473,086 | A | | 9/1984 | Thaler et al. | |
| 4,593,708 | A | | 6/1986 | Goeller et al. | |
| 4,664,132 | A | * | 5/1987 | Schillig | 132/271 |
| 4,866,248 | A | | 9/1989 | Altamore | |
| 5,046,516 | A | * | 9/1991 | Barradas | 132/232 |
| 5,186,188 | A | | 2/1993 | Fasolt | |
| 5,191,907 | A | | 3/1993 | Hirzel | |
| 5,400,810 | A | * | 3/1995 | Taylor | 132/232 |
| 5,513,665 | A | * | 5/1996 | Chan | 132/228 |
| 5,558,107 | A | | 9/1996 | Kim | |
| 6,554,000 | B2 | * | 4/2003 | Lin | 132/232 |
| 6,627,852 | B1 | | 9/2003 | Savone | |
| 8,132,571 | B1 | * | 3/2012 | Jackson | 132/211 |
| 8,539,964 | B2 | * | 9/2013 | Rong | 132/232 |
| 8,646,465 | B2 | | 2/2014 | Tam et al. | |
| 2003/0052115 | A1 | | 3/2003 | Leung | |
| 2005/0172980 | A1 | * | 8/2005 | Julemont | 132/231 |
| 2006/0237418 | A1 | | 10/2006 | Bousefield et al. | |
| 2007/0175881 | A1 | | 8/2007 | Yeung | |
| 2007/0278205 | A1 | * | 12/2007 | Pencook | 219/222 |
| 2010/0263684 | A1 | | 10/2010 | De Benedictis | |
| 2011/0284020 | A1 | * | 11/2011 | Tam | 132/211 |
| 2012/0111354 | A1 | * | 5/2012 | Cafaro et al. | 132/211 |
| 2013/0025621 | A1 | | 1/2013 | De Benedictis | |
| 2013/0068245 | A1 | | 3/2013 | De Benedictis et al. | |
| 2013/0125919 | A1 | | 5/2013 | De Benedictis et al. | |
| 2013/0263882 | A1 | | 10/2013 | Kim et al. | |
| 2013/0263883 | A1 | | 10/2013 | Story | |
| 2014/0366909 | A1 | | 12/2014 | Richmond et al. | |

FOREIGN PATENT DOCUMENTS

| | | |
|---|---|---|
| CN | 102783803 | 11/2012 |
| CN | 202722897 | 2/2013 |
| CN | 203207435 | 9/2013 |
| DE | 8206841 | 7/1982 |
| DE | 4312453 | 10/1994 |
| EP | 0057094 | 8/1982 |
| EP | 0571389 | 6/1996 |
| EP | 2622989 | 8/2013 |
| EP | 2392222 | 9/2013 |
| FR | 1327927 | 5/1963 |
| GB | 1530360 | 10/1978 |
| GB | 2277261 | 10/1994 |
| JP | 3988960 | 10/2007 |
| JP | 3185229 | 8/2013 |
| KR | 1020020015082 | 2/2002 |
| KR | 101166913 | 7/2012 |
| KR | 101263801 | 5/2013 |
| KR | 101326212 | 11/2013 |

OTHER PUBLICATIONS

Cortex 4-in-1 Ceramic Clipless Curling Iron Set, Folica, http://www.folica.com/tools/curling-irons/cortex-professional-4-in-1-ceramic-clipless-curling-iron-set#tab=overview, (Screenshot taken on Nov. 25, 2013).

Cortex Clipless Curling Iron, Folica, http://www.folica.com/tools/curling-irons/cortex-clipless-curling-iron#tab=overview, (Screenshot taken on Nov. 25, 2013).

3/4 Clipless Curling Iron—19mm—Turquoise, Brilliance New York, http://www.brilliancenewyork.com/product/34-clipless-curling-iron-19mm-turquoise/, (Screenshot taken on Nov. 25, 2013).

International Search Report for related International Patent Application No. PCT/US2014/64082 mailed on Feb. 4, 2015 (3 pages).

Written Opinion for related International Patent Application No. PCT/US2014/64082 mailed on Feb. 4, 2015 (6 pages).

Evaluation Report of Utility Model Patent No. ZL2014201064595, dated Jun. 4, 2015.

Japanese Office Action for Japanese Application No. 2014-134312, mailed Jul. 14, 2015.

* cited by examiner

HAIR CURLING DEVICES AND RELATED SYSTEMS AND METHODS

RELATED APPLICATIONS

This application claims the benefit of U.S. Provisional Patent Application Ser. No. 61/901,969 filed Nov. 8, 2013, entitled "Hair Curling Devices and Related Systems and Methods," the contents of which are hereby incorporated herein by reference in their entirety.

TECHNICAL FIELD

This disclosure relates generally to hair styling devices, and more specifically to hair curling devices and related systems and methods.

BACKGROUND

Heated styling irons (e.g., curling irons) are used to form hair to a wide variety of styles, such as curling hair to impart a curl that does not naturally occur or straightening hair to remove a kink or curl. For example, a circular or semicircular-shaped curl can be created by wrapping hair around the outer surface of a heated cylindrically shaped curling iron tip.

Conventional curling irons include a cylindrical curling mandrel having a clamping member that fits about a portion of the mandrel. During use, the curling mandrel can be heated and a strand of hair is clamped against the mandrel by the clamping member. Hair can be curled by rotating the mandrel to cause the clamped hair to be wrapped around the mandrel. Heat applied to the mandrel can alter the texture of the hair so as to curl it. After a predetermined amount of time, the clamping member is moved away from the mandrel, and the curled hair is unwound. Some conventional devices include a motorized heated mandrel that can rotate to wind hair around the mandrel using an electric motor.

SUMMARY

In some aspects, a hair styling apparatus (e.g., hair curling device) can include a heated barrel connected to a handle device and generally stationary relative to the handle device during use, the heated barrel defining a hair styling surface; and a rotating member disposed at an end of the hair styling surface, the rotating member being configured to rotate relative to the hair styling surface and to gather a user's hair and wind the hair around the hair styling surface.

In some aspects, a hair styling apparatus (e.g., hair curling device) can include a heated barrel coupled to a handle device and generally stationary relative to the handle device during use, the heated barrel defining a hair styling surface; and a rotating member disposed at an end of the hair styling surface and configured to rotate relative to the hair styling surface, where the rotating member includes one or more hair retaining elements disposed around a peripheral region of the rotating member and spaced away from the hair styling surface by a first radial spacing, the hair retaining elements configured to collect a user's hair and wrap the hair around the hair styling surface of the heated barrel; and a tab element extending from a first end of the rotating element along the hair styling surface and being spaced from the hair styling surface by a second radial spacing, the tab being configured to depress the hair onto the hair styling surface.

Embodiments can include one or more of the following features

In some embodiments, the barrel and/or the hair styling surface can include a free exposed end that is generally free from a housing or another enclosure that captures hair within a region of the device. For example, the barrel can be an unenclosed barrel having an unenclosed hair styling surface.

In some embodiments, the hair styling apparatus can include a heating element configured to heat the barrel and/or hair styling surface.

In some embodiments, the handle device can be a generally cylindrical structure configured to be grasped by a user.

In some embodiments, the rotating member rotates relative to the handle. In some embodiments, the rotating member includes a tab extending from a first end of the rotating member to capture and depress wound hair against the hair styling surface. In some cases, the rotating member includes an insert disposed along an inner surface of the tab to generate a frictional force against hair depressed between the tab and the hair styling surface. In some embodiments, the rotating member includes a generally cylindrical section extending from a second end of the rotating member. In some cases, the generally cylindrical section includes a tapered hair loading section.

In some embodiments, the rotating member includes one or more retaining elements configured to grasp and retain the hair. In some examples, the retaining elements are spaced from the hair styling surface by a radial spacing. In some cases, the retaining elements include projections extending from the rotating member. In some cases, the projections extend from a peripheral region of the rotating member. In some cases, the retaining elements include recesses defined within the rotating member. For example, the recesses can include semi-circular recesses. The semi-circular recesses can include recesses formed of at least half circular (e.g., equal to, larger than, or greater than half circular) recesses. The semi-circular recesses can alternatively or additionally include recesses formed of less than half circular (e.g., smaller than half circular) recesses. In some embodiments, central axes of the recesses can be spaced inward or outward radially away from a peripheral surface of the rotating member by a spacing. In some embodiments, the recesses can include one or more entraining portions extending into the recesses. In some embodiments, the retaining elements can alternatively or additionally include projections extending from the rotating member.

In some embodiments, the hair styling surface is disposed at a free end of the hair styling apparatus. In some embodiments, the end of the styling surface at which the rotating member is disposed is generally opposite the free end of the hair styling apparatus. In some cases, the free end is configured to be placed near or along a surface of the user's head. In some examples, the hair is wound from the end of the hair styling surface that is opposite the free end of the hair styling apparatus.

In some embodiments, the first radial spacing is greater than the second radial spacing.

In some embodiments, the rotating member can include a generally cylindrical portion extending from a second end of the rotating member opposite the first end. In some cases, the generally cylindrical portion comprises a tapered shape that decreases in width along an axis extending away from the first end.

In some embodiments, one or more of the hair retaining elements are longitudinally spaced away from the hair styling surface relative to a longitudinal axis of the barrel.

The hair styling devices described herein can be used to implement any of various hair styling methods. For example, in some aspects, a method can include positioning a free end of a hair styling surface of a hair styling device in proximity to a user's head; retaining hair attached to a user's head within a rotating member of the hair styling device at an end of the hair styling surface generally opposite the free end; and wrapping the retained hair around the hair styling surface to impart a curl in the hair.

In some embodiments, the wrapping the retained hair can include rotating the rotating member relative to the hair styling surface. In some cases, the hair can be retained automatically as the rotating member rotates. For example, the hair can be retained within one or more retaining elements formed along the rotating member.

In some embodiments, the method also includes depressing some or all of the hair against the hair styling surface at the end opposite the free end using a tab extending from the rotating member.

In some embodiments, as the hair is wrapped around the hair styling surface, free end regions of the hair are drawn through one or more regions of the rotating member and onto the hair styling surface. For example, the one or more regions can be hair retaining elements.

In some embodiments, a region of the hair in proximity to the user's head is first wrapped around the hair styling surface and a length of the free end of the hair decreases as the hair is wrapped around the hair styling surface.

In some aspects, the hair curling devices described herein include a rotating member that is configured to rotate and wrap hair around a generally stationary heated barrel to curl a user's hair more easily than with conventional curling devices. In particular, the hair curling devices described herein can automatically curl hair without requiring substantial twisting or rotating of the user's hand to wrap hair around the barrel as a result, in part, of the rotating member wrapping hair around the heated barrel. The automated manner in which the hair curling devices operate can help to reduce effort required by the user, making the hair curling device easier to use.

Additionally, in some embodiments, the hair curling devices described herein can be used more easily than other types of semi-automated curling irons (e.g., curling irons having rotating heated mandrels) by reducing the likelihood that hair will become stuck or snagged on the rotating member, which can cause discomfort or injury to the user by undesirably pulling at the user's hair. In particular, the curling irons having rotating heated mandrels can sometimes cause hair to effectively become stuck on the rotating mandrel. As a result, the hair can become wound too tight around the mandrel and pull at the user's scalp.

Further, some conventional curling irons having rotating heated mandrels utilize (or even require) a clutch device that helps to limit the force at which hair can be pulled from the scalp. However, as described below, in some embodiments, the hair curling devices described herein can reduce (in some cases eliminate) the need to have a clutch or rotational force limiting devices as a result, at least in part, of the configurations described herein having the rotating member that rotates and wraps hair around the generally stationary heated barrel. Such a configuration does not require a clutch device and can therefore be manufactured in a less complex manner as a result of requiring fewer components and in some embodiments at a reduced cost. Also, the clutch devices in the conventional curling irons may have the potential to degrade or fail and cause discomfort or injury to the user. Therefore, the hair curling devices described herein, which typically do not require clutch devices, can be more comfortable and safer to use than some conventional motorized curling irons.

Similarly, in some cases, a hair styling device as described herein including a heated barrel defining a hair styling surface that is free from a housing or enclosure can help to limit hair from inadvertently being caught or overly wound within the device. That is, a free, exposed barrel and styling surface can help to make the hair styling devices described herein easier (e.g., safer) to use and in some cases more effective by reducing the areas or regions in which hair can be caught and snagged during use. Further, in some embodiments, positioning the rotating member, in particular the retaining elements of the rotating member, along the barrel at an end of the hair styling surface (i.e., rather than being disposed somewhere along the styling surface) can also help to limit hair from inadvertently being caught or overly wound around the styling device, for example, in between the hair styling surface and the rotating member.

DETAILED DESCRIPTION

Figure 1:
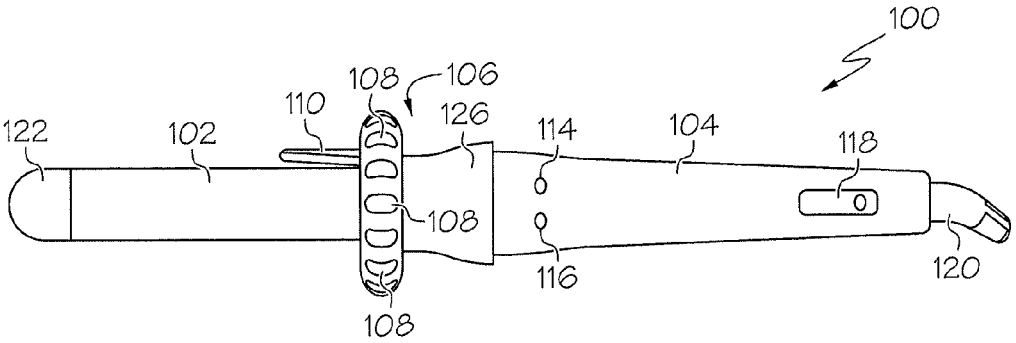
FIG. 1 is a side view of an example hair curling device having a rotating member to curl hair around a stationary heated barrel.
Figure 2:
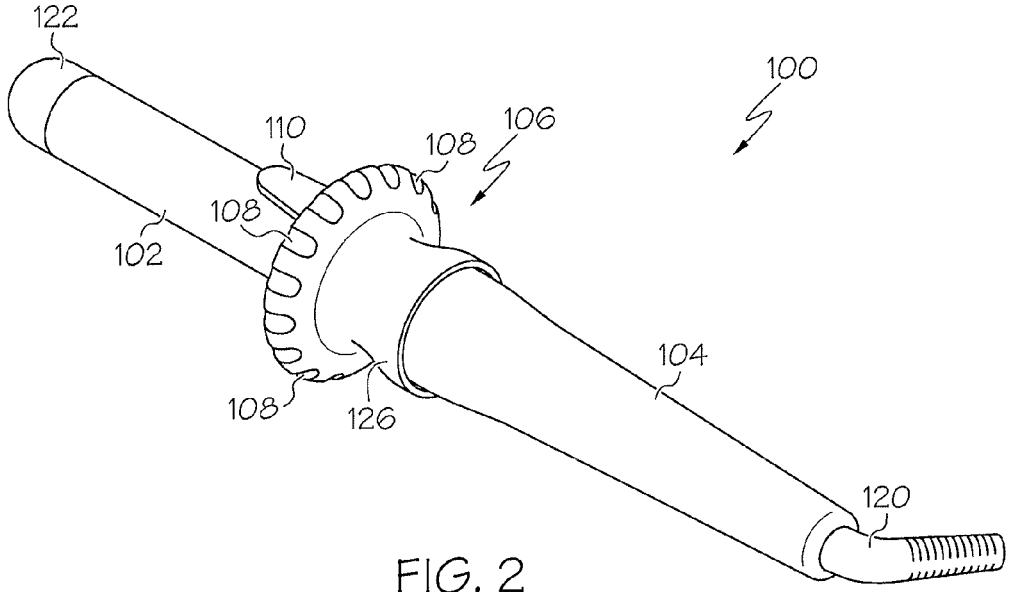
FIG. 2 is a perspective view of the hair curling device of FIG. 1.
Figure 3:
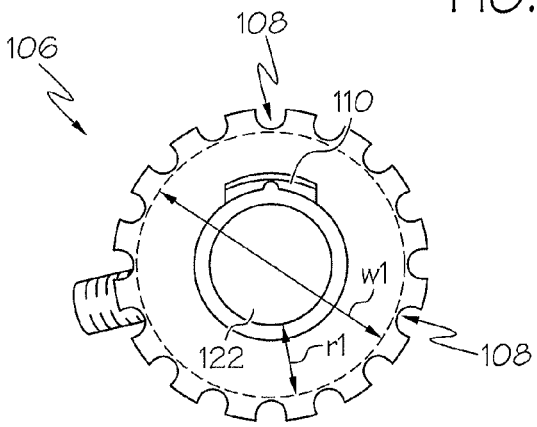
FIG. 3 is a front view of the hair curling device of FIG. 1 illustrating recessed hair retaining elements and a radial spacing between the hair retaining elements and the heated barrel.

Hair curling devices that include a rotating member that is configured to rotate and wrap hair around a generally stationary heated barrel can be used to curl a user's hair more easily than with some other conventional curling devices.

In some embodiments, referring to FIGS. 1-4, a hair styling (e.g., curling) device or apparatus 100 can include a heated barrel (e.g., a generally cylindrical barrel) 102 coupled to a housing (e.g., a handle) 104. The barrel 102 defines a hair styling surface that typically does not rotate relative to (e.g., is rotatably coupled to) the handle 104 and provides a device around which hair can be wrapped and heated to create curls. The barrel 102 typically includes a heating element (e.g., a ceramic heating element) 103 configured to heat at least a portion of the barrel 102, such as the hair styling surface, to curl a user's hair. A heat selection switch 118 can be arranged along the handle, which is configured to permit the user to select between one of several different heat settings, such as a high temperature setting and a low temperature setting.

The barrel 102 is typically formed of a thermally conductive metal material, such as aluminum, iron, steel, silver, or one or more other metals, that is surrounded (e.g., coated or wrapped) with a material that is less thermally conductive than the barrel (e.g., a thermally non-conductive material) that is configured to limit damage to the hair, such as a ceramic material or Tourmaline. The barrel 102 can be formed in various widths (e.g., diameters) based on the intended curls desired by the user. In some embodiments, the barrel 102 can have a diameter that is about 0.375 inches to about 2.5 inches (e.g., about 0.5 inches to about 1.5 inches). In the example illustrated, the barrel 102 has a diameter that is about 0.75 inches.

A tip (e.g., a heat insulated cooling tip) 122 can be disposed at a free, exposed end of the barrel 102. In some embodiments, the free end of the barrel is disposed opposite the handle. The cooling tip 122 can help to reduce the likelihood that the user will burn themselves with the heated barrel 102, for example, by creating a physical barrier between the end of the barrel 102 and the user's head. As illustrated, the free, exposed end of the styling device (e.g., exposed, free end of the barrel and styling surface) is typically free of hair capturing housings or enclosures. That is, the barrel is typically unenclosed and open to the surrounding environment so that hair can be more easily captured and wrapped around the hair styling surface and also more easily removed. In some cases, such an enclosure or housing could create an obstruction that may make it more difficult for a user to easily remove hair from the styling device. For example, hair could get wound around one or more surfaces of the enclosure making it difficult to remove from the hair.

A rotating member 106 is mounted generally at an end of the barrel 102 (i.e., at an end of the hair styling surface) adjacent to the handle 104. The rotating member 106 is rotatable relative to the hair styling surface of the barrel and typically also the handle 104 as the handle 104 and the barrel 102 can be coupled to one another. A drive motor 107 (illustrated more particularly in the embodiments depicted in FIGS. 5-9), which can be mounted in the handle (e.g., in a motor holding chassis) is configured to rotate the rotating member 106 relative to the handle 104 and the barrel 102. The drive motor 107 is typically an electric motor (e.g., an AC or a DC electric motor). Electricity can be provided to the drive motor using a rotatable power cord (e.g., a swivel power cord) 120 and directional switches 114, 116 that can cause the motor to rotate in different (e.g., opposite) directions. An electrical circuit (e.g., a printed circuit board) 117 (also illustrated in the embodiments depicted in FIGS. 5-9) can be arranged within the handle or another component to distribute electrical signals from the various switches to the motor 107 and heating element 103. While the handle 104 is illustrated as generally being a cylindrical member formed in-line with the heated barrel 102, other configurations are possible. For example, in some embodiments, the handle can be a pistol grip-like handle that is arranged at an angle (e.g., substantially perpendicular) relative to the heated barrel.

The hair curling device 100 can include any of various drivetrain components (e.g., gear systems or transmission devices) to convert the rotation of the motor into the rotation of the rotating member 106. The drive motor (including any drivetrain components) can be configured to rotate the rotating member 106 at any of various suitable speeds. For example, the drive motor can cause the rotating member 106 to rotate at about 10 rpm to about 300 rpm (e.g., about 20 rpm to about 100, e.g., about 50 rpm to about 100 rpm). Bearing elements can be disposed between the rotating member 106 and the barrel 102 or handle 104 to help reduce and limit rotational friction so that the rotating member 106 can rotate more easily relative to the barrel 102.

The rotating member 106 is typically configured to rotate relative to the barrel 102 (e.g., around the hair styling surface) to receive (e.g., gather, grasp, retain, trap, grip, pick, or otherwise attach) hair and wrap the hair around the heated barrel 102 to be curled as it rotates. As illustrated, the rotating member 106 includes one or more hair retaining elements 108 configured to receive a user's hair (e.g., one or more hairs) so that the hair can be wrapped around the styling surface of the heated barrel 102 for curling. The rotating member 106 typically includes multiple retaining elements 108 that are distributed circumferentially around its perimeter region. In some cases, including multiple retaining elements 108 can help the hair curling device more easily retain and wrap hair around the barrel 102 in a more uniform, even distribution.

The rotating member 106 and the retaining elements 108 are typically longitudinally spaced away from the barrel (e.g., the hair styling surface of the barrel) and disposed at an of the barrel adjacent the handle 104. That is, the hair styling surface can be positioned at the free, exposed end of the hair styling device relative to the rotating member 106. As discussed below and illustrated in FIGS. 10A-11B, such a configuration can enable the user to place the free end of the curling device towards their head so that the rotating member can gather the user's hair and wrap the free end of the hair around the heated barrel 102. In other words, hair is typically gathered using the rotating member and wound around the hair styling surface from an end opposite the free end of the hair styling surface.

Figure 4:
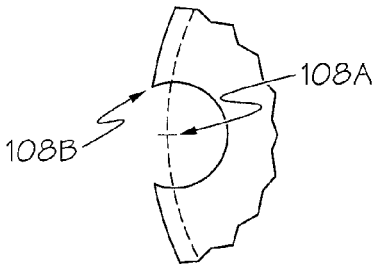
FIG. 4 is an enlarged view of the rotating member of FIG. 1 illustrating a hair retaining element.
Figure 5:
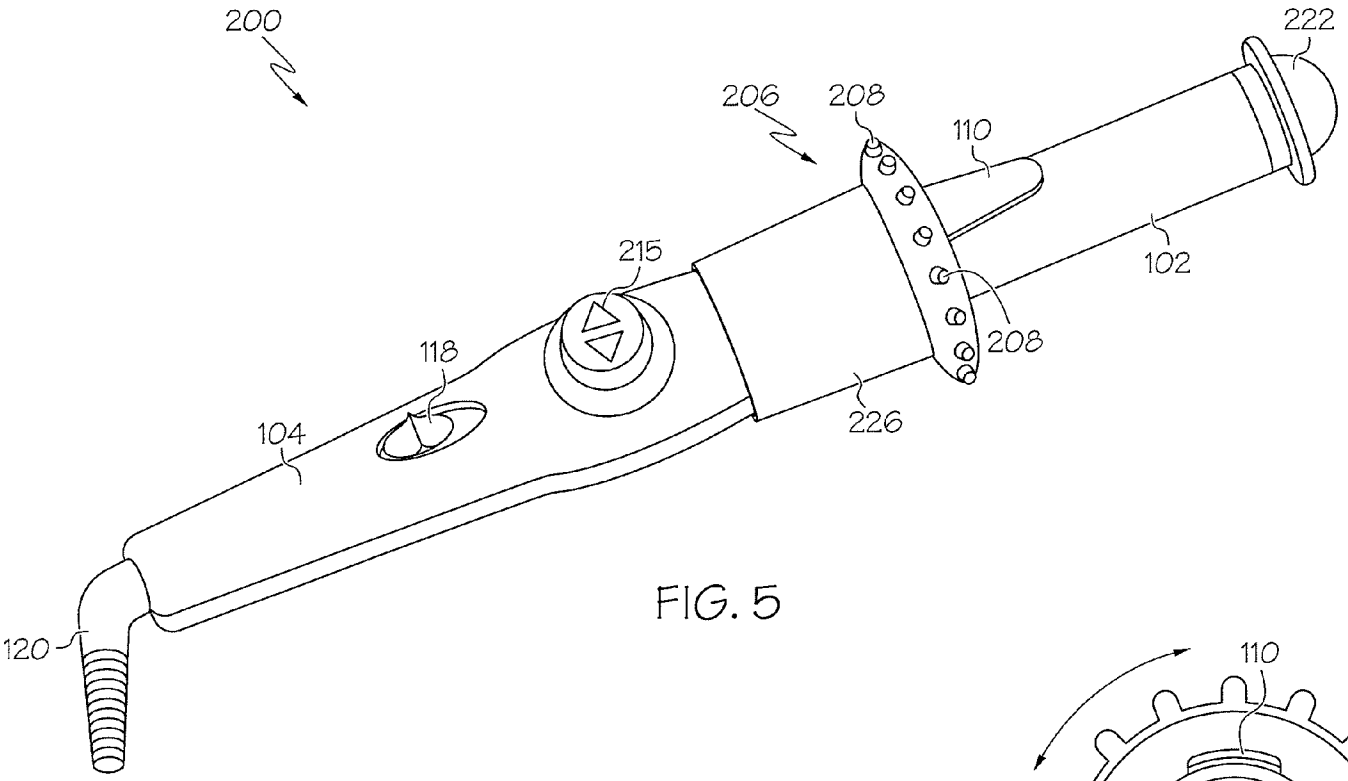
FIG. 5 is a perspective view of another example hair curling device having a rotating member with projection-like hair retaining elements to grasp and curl hair around a stationary heated barrel.
Figure 7:
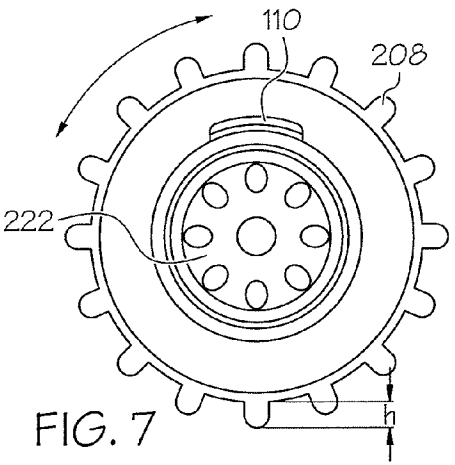
FIG. 7 is a front view of the hair curling device of FIG. 5 illustrating a length of projection-like elements.
Figure 6:
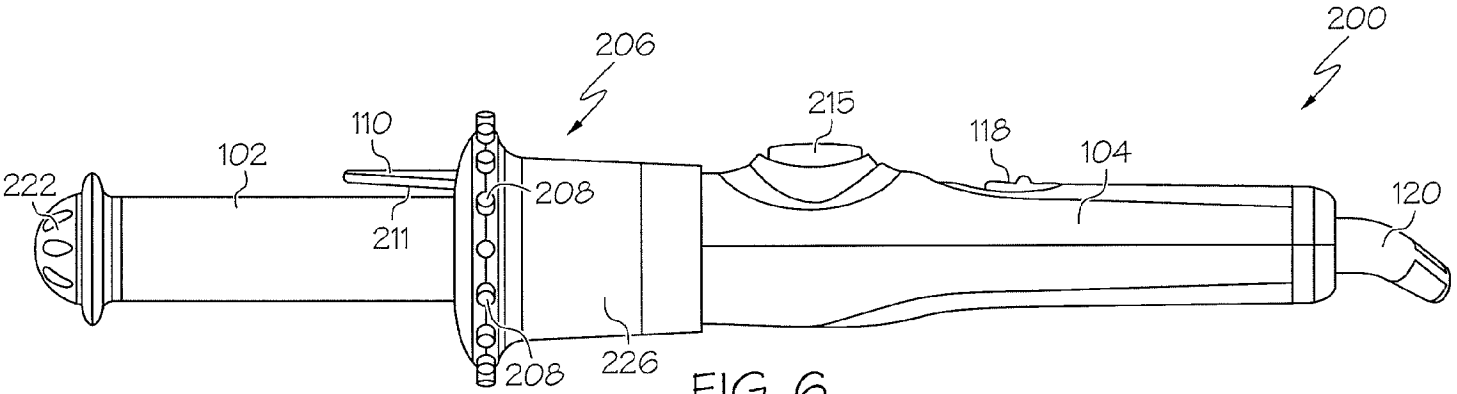
FIG. 6 is a side view of the hair curling device of FIG. 5.

Retaining elements formed along the rotating member can include any of various types of features capable to catch or gather one or more hairs. For example, the retaining elements can include one or more of hooks, recesses (e.g., semi-circular holes or other depressions), protrusions (e.g., knobs, pins, bristles, bosses), or any suitable combinations or these of other suitable elements. As shown in FIGS. 1-4, in some examples, the rotating member 106 can include multiple recess-like retaining elements 108 that are formed circumferentially around an outer (e.g., peripheral) region around the rotating member 106. Recess-like retaining elements can be formed in any of various shapes and sizes to suitably gather a user's hair. In some embodiments, retaining elements can have a depth or width (e.g., diameter) that is at least 0.5 millimeters (e.g., about 1 millimeter to about 10 millimeters). In the example illustrated, the semi-circular retaining elements 108 can have a diameter that is about 6 millimeters. Referring particularly to FIG. 4, recess-like retaining elements 108 can be formed within a peripheral region of the rotating member such that their central axes 108A are arranged within the rotating member so that at least half of the recess (e.g., at least half of a semi-circular recess) is enclosed. Put differently, the retaining elements 108 can include portions (e.g., entraining portions) 108B of the rotating member that extend inwardly towards the recess to partially enclose the retaining elements. The entraining portions 108B can help to retain hair within the retaining elements as the rotating member rotates.

In some cases, the retaining elements 108 are distributed substantially evenly around the rotating member. In some embodiments, retaining elements can be arranged about every 5 degrees to about 10 degrees around the peripheral region of the rotating member. Additionally or alternatively, in some embodiments, the retaining elements can be arranged about every 0.125 inches to about 0.75 inches around the peripheral region of the rotating member.

Retaining members can be arranged in a width (e.g., diameter) w1 that is at least 20 percent greater than the diameter of the barrel around which they rotate. For example, retaining members can be arranged along a peripheral region of the rotating member in a diameter w1 of about 1 inch to about 5 inches (e.g., about 2 inches to about 3.5 inches). In some cases, the diameter w1 around which the retaining elements are positioned can be at least about 20 percent larger than the diameter of the barrel. In the example illustrated, a diameter w1 defined by the retaining elements 108 is about 2 inches.

As illustrated, the retaining elements are typically spaced radially away from the barrel 102 by a separating spacing r1 so that hair retained by the rotating member is generally spaced away from the heated barrel 102. Spacing the retaining elements 108 radially away from the barrel 102 in this manner can help reduce the likelihood of hair tangling when first grasped by the rotating member 106. In some embodiments, a radial spacing r1 between the hair styling surface of the barrel and the retaining members can be 0.125 inches to about 2 inches. In the example illustrated, the radial spacing is about 0.5 inches.

The rotating member 106 typically can also include a hair holding tab 110 that extends generally longitudinally along the hair styling surface the heated barrel 102. As the retaining elements 108 catch and rotate (e.g., twist, curl, wrap, spiral, or otherwise displace) hair around the barrel 102, the holding tab 110 helps to further catch hair and direct and guide it against and around the barrel 102 so that the hair spirals around the barrel rather than just twisting or tangling. In some embodiments, the tab 110 can have a length to extend onto the hair styling surface about 5 millimeters to about 50 millimeters. The tab 110 can be spaced from the hair styling surface by about 0.5 millimeters to about 10.0 millimeters to provide adequate room for hair to fit between the tab 110 and barrel 102.

In some cases, the holding tab 110 can include a surface or insert of a material that helps to create additional friction against the hairs to grip and wrap the hairs around the barrel 102. For example, the insert can include an insert made of a silicon or one or more other fluoroelastomers disposed between holding tab 110 and the barrel 102 to help generate a frictional force against the hair depressed between the tab and the hair styling surface of the barrel. Additionally or alternatively, in some embodiments, the insert can be in the form of a coating formed along the holding tab. Like the tab 110, the insert can be spaced from the hair styling surface, for example, by about 0.5 millimeters to about 10.0 millimeters to provide adequate room for hair to fit between the insert and barrel 102.

The rotating member 106 typically has a generally cylindrical hair loading region 126 along which hair that is about to be retained by the retaining elements 108 and wound around the barrel 102 can lie. As illustrated, the hair loading region 126 is typically longer relative to the other portions of the rotating member 106 and is positioned at an end away from the barrel 102 when the rotating member 106 is mounted on the hair curling device 100. In some embodiments, the hair loading region 126 can have a length that is about 5 millimeters to about 70 millimeters. However, other position configurations are possible. The hair loading region can be formed integrally within the rotating member or, in some cases, can be manufactured as a separate component joined (e.g., fastened) to the rotating member. The hair loading region 126 typically serves to help reduce the likelihood that hair becomes inadvertently wound around the rotating member 106 and tangled before it can be wrapped around the barrel 102.

Wrapping the user's hair around the barrel 102 in this manner, including winding the hair around the relatively stationary (i.e., non-rotating) barrel 102 using the rotating member 106 rather than clamping the hair to the barrel and rotating the barrel itself can result in fewer snags, tangles, or pulled hairs during use. This enhanced performance is, at least in part, a result of the hair being pulled loosely by the retaining elements 108 and the holding tab 110, neither of which tightly clamp onto the hair. In other words, when the rotating member 106 rotates to grip and rotate (e.g., twist, curl, wrap, spiral, or otherwise displace) hair (rather than clamping hair to the barrel and rotating it), the hair is guided around the barrel 102 and as it is formed into a spiral-like curl, it is tightened to the stationary barrel rather than a moving part, which could cause the hair to be pulled causing discomfort. Therefore, the rotating members described herein can typically reduce (or in some embodiments eliminate) the need for additional protection components such as clutches or sensor systems.

Another example automated hair styling apparatus (e.g., hair curling device) having a stationary hair styling surface of a heated barrel around which hair can be wrapped and curled is illustrated in FIGS. 5-9. For example, a hair curling device 200 can include a rotating member 206 configured to retain and wind the hair around the heated barrel 102 to curl the hair. Similarly to the rotating member 106 described above, the rotating member 206 can include retaining elements spaced away from one another to engage one or more hairs of the user. As discussed above, retaining elements can include any of various types of features capable to catch one or more hairs, such as one or more of hooks, recesses, protrusions (e.g., knobs, pins, bristles, bosses), or any suitable combinations of these of other suitable elements. As shown in the example illustrated, the rotating member 206 can include multiple knob-like protrusions 208 that extend outward radially and are disposed circumferentially around the rotating member 106.

Knob-like protrusion retaining elements can be formed in any of various sizes to suitably gather a user's hair. In some embodiments, protrusion retaining elements 208 can have a height h that is about 0.5 millimeters to about 10 millimeters outward radially from the rotating member 206. In some embodiments, protrusion retaining elements 208 can have a width that is about 1 millimeter to about 3 millimeters (e.g., about 1 millimeter to about 2 millimeters).

In some cases, the retaining elements 208 are distributed substantially evenly around the rotating member. The spacing of adjacent retaining elements 208 can help to create recess-like regions in which hair can lie and be retained.

The rotating member 206 includes a hair loading region 226 positioned away from the barrel 102 that can help to limit hair from getting wound and tangled around the rotating member 206. In some embodiments, the hair loading region 226 can include a tapered portion that increases in width (e.g., diameter) as it leads into the retaining elements 108. Such a tapered portion can help gradually push the hair outward radially so that it can more easily be retained by the retaining members.

The rotating member 206 can include a friction insert (e.g., a silicon insert) 211 disposed along an inner surface of the hair holding tab 110. As mentioned above, as the retaining elements 108 catch and twist hair around the barrel 102, the holding tab 110 helps to press the hair against the barrel 102 for better contact with the with barrel 102. The friction insert 211 helps to create friction to wrap the hair around the barrel 102 without firmly clamping or gripping.

A tip (e.g., a heat insulated cooling tip) 222 can be arranged at the exposed, free end of the barrel 102. As illustrated, in some cases, at least a portion of the cooling tip 222 has a width (e.g., diameter) that is larger than the barrel 102 to help keep the user from accidently placing the sides of the barrel 102 on their head. The larger diameter region can also provide a stop to limit hair from slipping off the end of the barrel.

Figure 8:
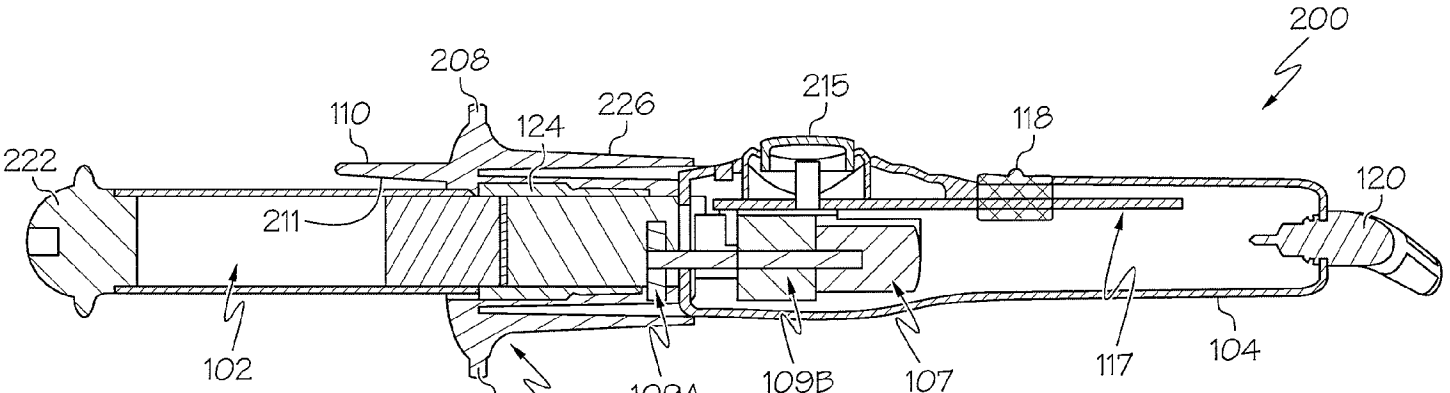
FIG. 8 is a cross-sectional side view of the hair curling device of FIG. 5 illustrating inner components that drive the rotating member.
Figure 9:
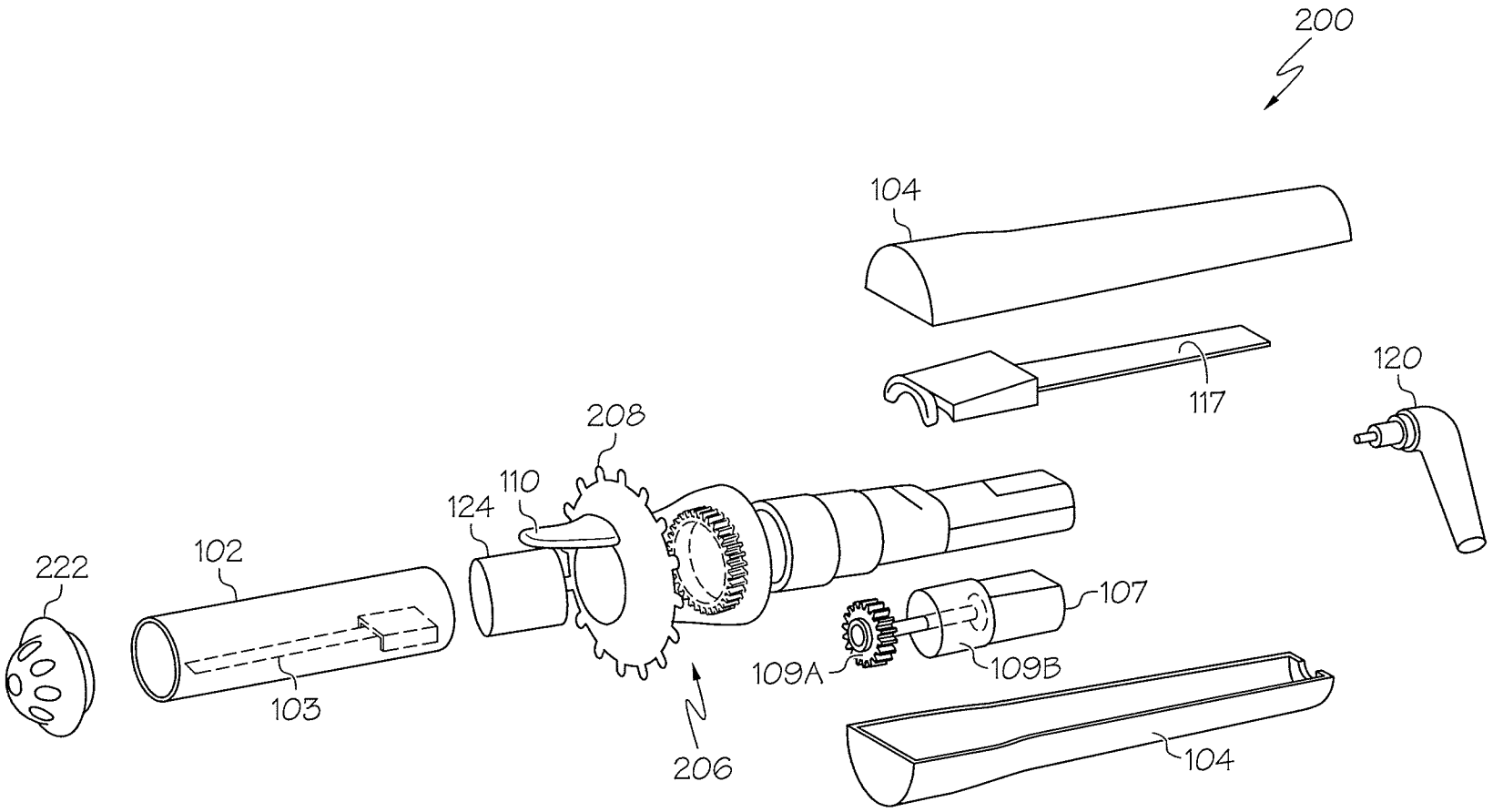
FIG. 9 is an exploded, perspective view of the hair curling device of FIG. 5.

As illustrated in FIGS. 8 and 9, drivetrain components, such as gear systems 109A or transmission devices 109B, can be used to convert the rotation of the motor 107 into the rotation of the rotating member 206. Like the hair curling device 100, the drive motor 107 of the curling device 200 can cause the rotating member 206 to rotate at about 10 rpm to about 300 rpm (e.g., about 20 rpm to about 100, e.g., about 50 rpm to about 100 rpm). Referring particularly to FIG. 8, a bearing element 124 can be disposed between the rotating member 206 and the barrel 102 or handle 104 to help reduce and limit rotational friction so that the rotating member 206 can rotate more easily relative to the barrel 102.

The hair curling device 200 also includes directional switch (e.g., a toggle switch) 215 that can be used to change the rotational direction of the barrel 102 so that the user can create differently shaped curls. In some examples, the switch 215 can be a rocker switch, such as a three position rocker switch, that can change the direction of the barrel from left (e.g., counterclockwise), stop, and right (e.g., clockwise).

Unless otherwise explicitly noted or described, the hair curling device illustrated in FIGS. 5-9 can include similar or same components as those of the hair curling device 100. Similarly, the hair curling device 100 can include components or features described with respect to the hair curling device 200.

As discussed above, the hair styling devices as described generally herein (e.g., the hair styling device 100 or the hair styling device 200) can enable a user to place the styling device near their head so that the rotating member can automatically gather and wrap the hair to form curls by withdrawing free ends of the hair upwardly onto the heated barrel while limiting the risk of inadvertently pulling the hair from the user's head.

Figure 10C:
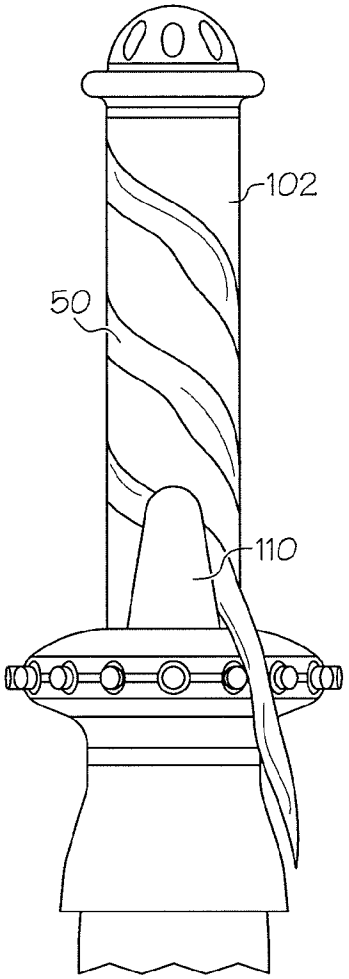
FIGS. 10A-10C are sequential views depicting a hair curling method implementing an example hair curling device.
Figure 10B:
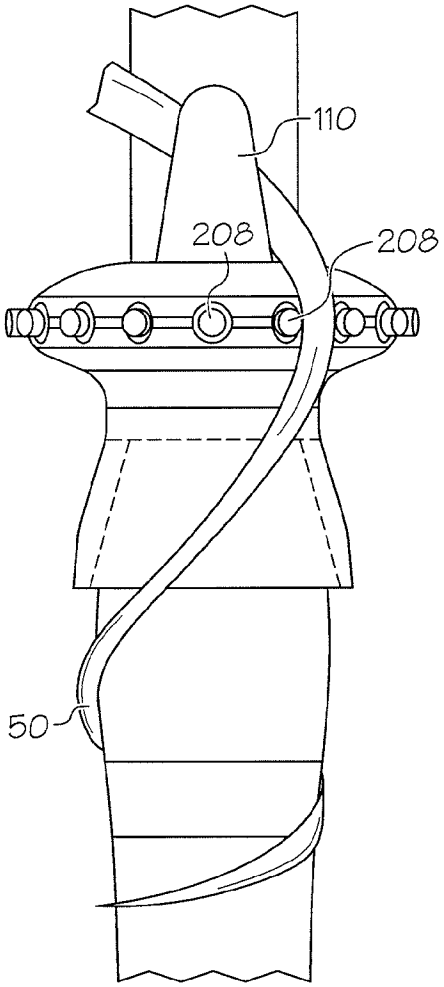
Figure 10A:
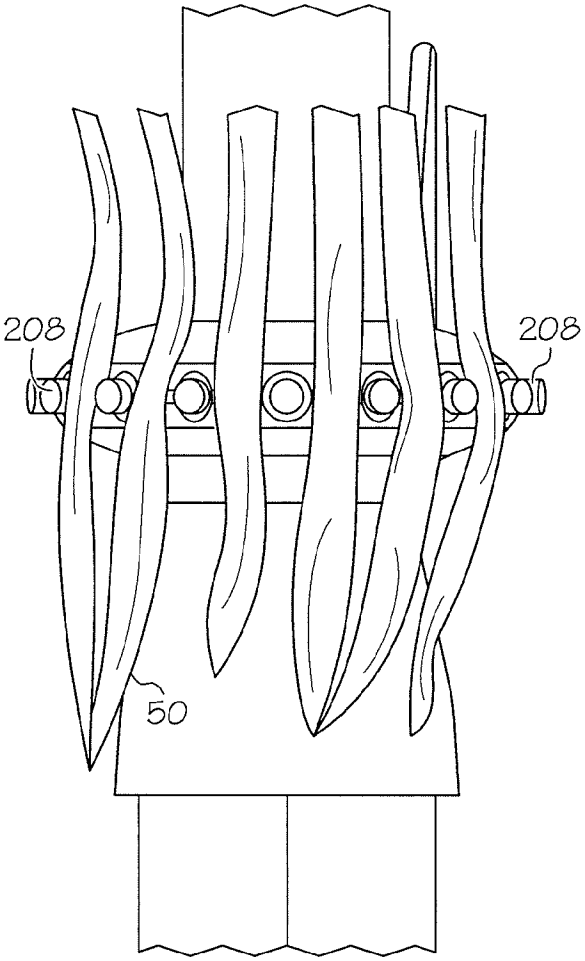

FIGS. 10A-10C depict a hair curling sequence that can be implemented using one of the hair curling devices described herein (e.g., the hair curling device 100 or the hair curling device 200). In some examples, a user can place the hair curling device against their hair with the cooling tip 122 directed towards their head. As depicted in FIG. 10A, hair can fall and lie along the rotating member and in particular, within the retaining elements. As mentioned above, the retaining elements are typically distributed apart from one another to comb through the hair to limit or prevent tangling.

As the rotating member begins to rotate relative to the generally cylindrical barrel, for example, as a result of the user pressing one of switches 114, 115, 116, the retaining members begin to wrap the hair around the barrel, as depicted in FIG. 10B. For simplicity, only one hair is shown in FIGS. 10B and 10C. As the hair is wound around the barrel, the holding tab can press and keep the hair on the barrel. Referring to FIG. 10C, the hair can continue to wind around the barrel as it is heated to form a curl in the hair. The user can either continue rotate or stop the rotating member while the hair is being heated and curled.

After a period of time has passed and the hair is heated, the user can remove the hair curling device from their hair. As discussed above, since the hair is not directly grasped, pinched, or held by the rotating member or the barrel (e.g., as would be the case for a curling iron with a clamp), the user can typically just pull the hair curling device away from their head. When pulled away, the hair can typically become loosened from the barrel and slide through the retaining elements.

Figure 11B:
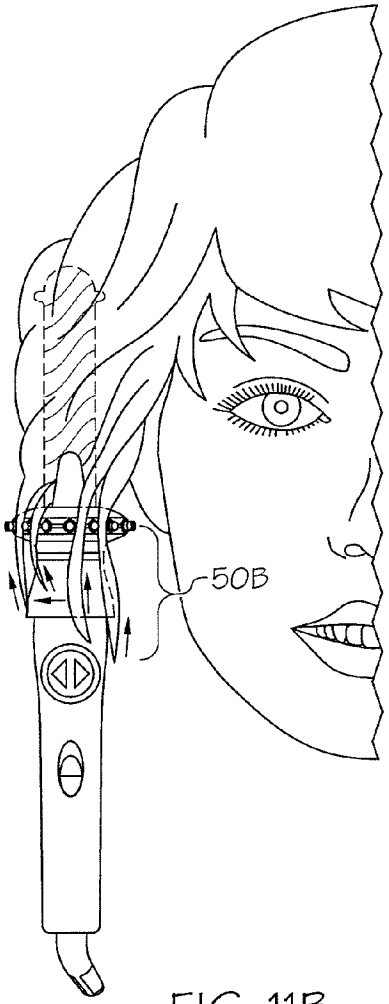
FIGS. 11A-11B are sequential views depicting the hair curling method implementing an example hair curling device illustrating how hair can be gathered and curled by the hair curling device.
Figure 11A:
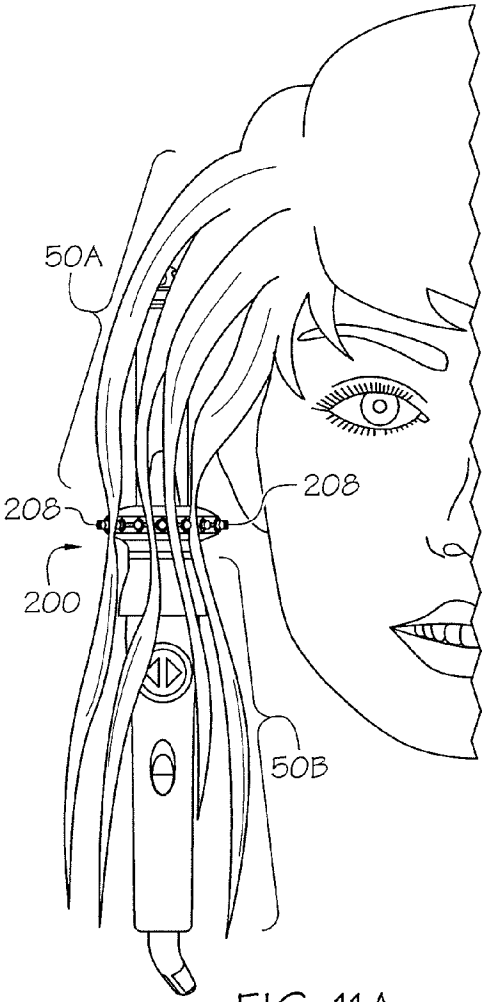

In another example, referring to FIG. 11A, a user can position a free end of a hair styling surface (e.g., defined by a heated barrel) of a hair styling device, such as the hair curling devices 100, 200 discussed above, in proximity to (e.g., at or near) the user's head. In some embodiments, the hair curling device (i.e., a longitudinal axis of the hair styling surface) can be positioned substantially vertically next to the user's head. As illustrated, hair can be retained (e.g., gathered) within a rotating member of the hair styling device. For example, hair can be gathered by retaining elements 108 of the rotating member. As shown, the hair can be retained at an end of the hair styling surface that is opposite the free end of the styling device.

Hair can then be wrapped around the heated hair styling surface. For example, referring to FIG. 11B, the rotating member can be driven to rotate relative to the hair styling surface based on an input from the user. In some embodiments, the rotating member can be driven in response to the user pressing a directional button on the handle. As illustrated, a portion 50A of the hair in proximity to (e.g., closest to) the user's head is first wrapped around the hair styling surface and a length of the free end (e.g., a free length or free end region) 50B of the hair decreases as the hair is wrapped around the hair styling surface. That is, as hair is wound, the portions closest to the head can first be wrapped around the barrel and the free length (e.g., the amount of hair that lies free from the styling device) 50B can be drawn up to the styling surface as the rotating member rotates and guides the hair through the retaining elements.

In some cases, as the rotating member rotates, additional hair can be gathered and retained automatically by the retaining elements of the rotating member. As the hair is wrapped around the heated hair styling surface, a curl can be imparted in the hair. As the rotating member rotates, the tab extending from the rotating member can be used to depress some or all of the hair against the hair styling surface at the end of the styling surface opposite the free end.

As illustrated, as the hair is wrapped around the hair styling surface, free end regions of the hair can be drawn through one or more regions (e.g., retaining elements) of the rotating member and onto the hair styling surface.

In some embodiments, the rotating member can continuously rotate about the barrel after the hair has been fully wrapped. In some cases, the rotating member can continue to rotate until the user releases the directional button (or pressed a stop button) on the handle.

After a period of time has passed and the hair is heated, the user can remove the hair curling device from their hair. As discussed above, since the hair is not directly grasped, pinched, or held by the rotating member or the barrel (e.g., as would be the case for a curling iron with a clamp) or enclosed by a hair capturing housing or enclosure, the user can typically just pull the hair curling device away from their head. When pulled away, the hair can typically become loosened from the barrel and slide through the retaining elements.

While the systems and methods described herein have been particularly shown and described above with reference to exemplary embodiments thereof, it will be understood, that various changes in form and detail can be made without departing from the spirit and scope of the systems and methods described and defined by this disclosure. Therefore, other embodiments are within the scope of this disclosure and the following claims.

What is claimed is:

1. A hair styling apparatus comprising:

a heated barrel connected to a handle device and generally stationary relative to the handle device during use, the heated barrel defining a heated barrel longitudinal axis extending through a middle of the heated barrel and a hair styling surface along its outer exterior surface that remains generally stationary relative to the handle device during use;

a heating element for heating the heated barrel; and a rotating member disposed at an end of the hair styling surface, the rotating member being configured to rotate around the stationary hair styling surface via a motor housed in the hair styling apparatus, and comprising:

a rotating plate having a constant diameter around an entire circumference of the heated barrel that is at least about 20 percent greater than a diameter of the heated barrel; and at least one retaining element attached directly to the rotating plate; and a tab defining a tab longitudinal axis extending through a middle of the tab, and extending from a rotating plate end of the rotating member along a longitudinal length of the hair styling surface over less than an entire longitudinal length of the hair styling surface to capture wound hair, wherein the tab is capable of being spaced apart from the entire longitudinal length of the hair styling surface while the heated barrel longitudinal axis is substantially parallel to but not coaxial with the tab longitudinal axis.

2. The hair styling apparatus of claim 1, wherein the rotating member rotates relative to the handle.

3. The hair styling apparatus of claim 1, further comprising one or more retaining elements, wherein the one or more retaining elements comprise projections extending from the rotating plate.

4. The hair styling apparatus of claim 3, wherein the projections extend from a peripheral region of the rotating plate.

5. The hair styling apparatus of claim 4, wherein the peripheral region of the rotating plate from which the projections extend has a diameter that is about 1 inch to about 5 inches.

6. The hair styling apparatus of claim 5, wherein the projections extend from an area of the peripheral region of the rotating plate that is spaced radially away from the heated barrel by a separating spacing of about 0.125 inches to about 2 inches.

7. The hair styling apparatus of claim 1, further comprising one or more retaining elements, wherein the one or more retaining elements comprise recesses defined within the rotating member.

8. The hair styling apparatus of claim 7, wherein central axes of the recesses are spaced radially inward away from a peripheral surface of the rotating member.

9. The hair styling apparatus of claim 7, wherein the recesses form one or more entraining portions extending into the recesses.

10. The hair styling apparatus of claim 1, wherein the hair styling surface includes a free end of the hair styling apparatus.

11. The hair styling apparatus of claim 10, wherein the end of the styling surface at which the rotating member is disposed is generally opposite the free end of the hair styling apparatus.

12. The hair styling apparatus of claim 1, wherein the tab is spaced apart from the hair styling surface at a fixed distance.

13. A hair styling apparatus comprising:

a heated barrel coupled to a handle device and generally stationary relative to the handle device during use, the heated barrel defining a heated barrel longitudinal axis extending through a middle of the heated barrel and a hair styling surface along its outer exterior surface that remains generally stationary relative to the handle device during use;

a heating element for heating the heated barrel; and a rotating member disposed at an end of the hair styling surface and configured to rotate around the stationary hair styling surface, the rotating member comprising:

a rotating plate that has a constant diameter around an entire circumference of the heated barrel that is at least about 20 percent greater than a diameter of the heated barrel;

one or more hair retaining elements disposed around a peripheral region of the rotating plate, the hair retaining elements configured to collect a user's hair and wrap the hair around the stationary hair styling surface of the heated barrel; and a tab element extending from a rotating plate end of the rotating element along a longitudinal length of the hair styling surface over less than an entire longitudinal length of the hair styling surface to capture wound hair, the tab element comprising a first end and a second end, wherein the first end of the tab element and the second end of the tab element are spaced apart from the hair styling surface, and a distance from the first end of the tab element to the hair styling surface is approximately the same as a distance from the second end of the tab element to the hair styling surface.

14. The hair styling apparatus of claim 13, wherein a generally cylindrical portion of the rotating member comprises a tapered shape that decreases in width along an axis extending away from the rotating plate end.

15. The hair styling apparatus of claim 13, wherein one or more of the hair retaining elements are longitudinally spaced away from the hair styling surface relative to the heat barrel longitudinal axis.

16. The hair styling apparatus of claim 13, wherein the retaining elements comprise projections extending from the rotating plate.

17. The hair styling apparatus of claim 13, wherein the retaining elements comprise semi-circular recesses defined within the rotating member.

18. The hair styling apparatus of claim 17, wherein the semi-circular recesses comprise recesses formed of at least half circular recesses.

19. The hair styling apparatus of claim 17, wherein the recesses form one or more entraining portions extending into the recesses.

20. The hair styling apparatus of claim 13, wherein the tab element is spaced apart from the hair styling surface at a fixed distance.

21. A method comprising:

providing a hair styling device, comprising:

a heated barrel connected to a handle device and generally stationary relative to the handle device during use, the heated barrel defining a heated barrel longitudinal axis extending through a middle of the heated barrel and a hair styling surface along its outer exterior surface that remains generally stationary relative to the handle device during use;

a heating element for heating the heated barrel; and a rotating member disposed at an end of the hair styling surface, the rotating member being configured to rotate around the stationary hair styling surface via a motor housed in the hair styling apparatus and comprising:

a rotating plate having a constant diameter around an entire circumference of the heated barrel that is at least about 20 percent greater than a diameter of the heated barrel; and at least one retaining element attached directly to the rotating plate; and a tab defining a tab longitudinal axis extending through a middle of the tab, and extending from a first end of the rotating member along a longitudinal length of the hair styling surface over less than an entire longitudinal length of the hair styling surface to capture wound hair, wherein the tab is capable of being spaced apart from the entire longitudinal length of the hair styling surface while the heated barrel longitudinal axis is substantially parallel to but not coaxial with the tab longitudinal axis;

positioning a free end of the hair styling surface in proximity to a user's head;

causing hair attached to the user's head to be placed at the rotating member; and wrapping the retained hair around the hair styling surface to impart a curl in the hair by rotating the rotating member around the stationary hair styling surface to wind the hair around the hair styling surface.

22. The method of claim 21, wherein the hair is retained as the rotating member is automatically rotated.

23. The method of claim 21, further comprising depressing some or all of the hair against the hair styling surface at the end opposite the free end using the tab extending from the rotating member.

24. The method of claim 21, wherein, as the hair is wrapped around the hair styling surface, free end regions of the hair are drawn through one or more regions of the rotating member and onto the hair styling surface.

25. The method of claim 21, wherein one or more retaining elements are disposed around a peripheral region of the rotating member, and the one or more retaining elements comprise recesses defined within the rotating member.

26. The method of claim 21, wherein a region of the hair in proximity to the user's head is first wrapped around the hair styling surface and a length of the free end of the hair decreases as the hair is wrapped around the hair styling surface.

27. The method of claim 21, wherein the tab is spaced apart from the hair styling surface at a fixed distance.

28. A hair styling apparatus comprising:

a heated barrel coupled to a handle device and generally stationary relative to the handle device during use, the heated barrel defining a heated barrel longitudinal axis extending through a middle of the heated barrel and a hair styling surface along its outer exterior surface that remains generally stationary relative to the handle device during use;

a heating element for heating the heated barrel; and a rotating member disposed at an end of the hair styling surface and configured to rotate around the stationary hair styling surface, the rotating member comprising:

one or more hair retaining elements comprising projections that extend from a peripheral region of the rotating member, the hair retaining elements configured to collect a user's hair and wrap the hair around the stationary hair styling surface of the heated barrel; and a tab element extending from a first end of the rotating element along a longitudinal length of the hair styling surface over less than an entire longitudinal length of the hair styling surface to capture wound hair, the tab element comprising a first end and a second end, wherein the first end of the tab element and the second end of the tab element are spaced apart from the hair styling surface, and a distance from the first end of the tab element to the hair styling surface is approximately the same as a distance from the second end of the tab element to the hair styling surface, wherein the peripheral region of the rotating member from which the projections extend has a constant diameter around an entire circumference of the heated barrel that is at least about 20 percent greater than a diameter of the heated barrel a diameter of the peripheral region is and about 1 inch to about 5 inches, and wherein the projections extend from an area of the peripheral region of the rotating member that is spaced radially away from the heated barrel by a separating spacing of about 0.125 inches to about 2 inches.

* * * * *